United States Patent [19]

Pressman

[11] 4,339,936

[45] Jul. 20, 1982

[54] ANNULAR CORRUGATOR

[75] Inventor: John R. Pressman, Northampton, England

[73] Assignee: UOP Inc., Des Plaines, Ill.

[21] Appl. No.: 202,909

[22] Filed: Nov. 3, 1980

[51] Int. Cl.[3] ..... B21D 15/04; B21D 17/04

[52] U.S. Cl. ..... 72/77; 72/98; 72/103

[58] Field of Search ..... 72/77, 78, 118, 119, 72/121–123, 282, 285, 95, 98, 103

[56] References Cited

U.S. PATENT DOCUMENTS

| | | | |
|---|---|---|---|
| 951,179 | 3/1910 | Davis et al. | 72/77 |
| 1,137,920 | 5/1915 | Sleeper | 72/282 |
| 1,979,134 | 10/1934 | Abramsen | 72/77 |
| 2,429,491 | 10/1947 | Schuler | 80/58 |
| 3,128,821 | 4/1964 | Andersen | 72/77 |
| 3,260,088 | 7/1966 | Gruetter et al. | 72/103 |
| 3,353,389 | 11/1967 | Kelstrom | 72/77 |
| 3,543,551 | 12/1970 | Raisch et al. | 72/77 |
| 3,568,489 | 3/1971 | Tobita | 72/77 |
| 3,583,189 | 6/1971 | Kelstrom | 72/77 |
| 3,656,331 | 4/1972 | Kuypers et al. | 72/77 |
| 3,788,113 | 1/1974 | Martin | 72/77 |
| 4,215,559 | 8/1980 | Kuypers | 72/77 |

FOREIGN PATENT DOCUMENTS

| | | | |
|---|---|---|---|
| 51-548 | 1/1976 | Japan | 72/77 |

*Primary Examiner*—Lowell A. Larson

*Attorney, Agent, or Firm*—James R. Hoatson, Jr.; Barry L. Clark; William H. Page, II

[57] ABSTRACT

Apparatus for producing annular corrugations in the wall of thin metal tubing in the manufacture of corrugated metal hose includes a plurality of dies. Each die comprises a helical rib of greater than 360° extent formed on the inner rim of an annular ring with the ribs on successive dies being progressively thinner and having successively closer pitches so as to progressively deepen the corrugations and make them narrower. The dies are preferably mounted to rotate in synchronization with each other at identical angular speeds, and are arranged in pairs in one or more stages with the dies in each stage engaging opposite sides of the tube.

7 Claims, 3 Drawing Figures

ANNULAR CORRUGATOR

BACKGROUND OF THE INVENTION

The invention relates to the manufacture of corrugated metal hose from thin-walled, seamless or butt-welded smooth tubing, and more particularly, to the formation of annular corrugations in such tubing on a continuous basis.

It has been known in the art, as disclosed in U.S. Pat. Nos. 3,128,821 and 3,353,389, that helical metal hose can be manufactured on a continuous basis by either rotating a tube through annular die rings which themselves are free to rotate, or by rotating the die rings about a non-rotating tube. Another process for making helical corrugations uses tapered helical dies rotating about a drawn tube moving in a straight line.

Annular metal hose is typically made by relatively slow procedures such as the internal bulging process and the external inward-forming process. The internal bulging process can produce excellent corrugation shapes, but operates at a relatively low speed and can only make relatively short lengths. The process utilizes a solid rubber bung which is compressed to prebulge the tube after which the corrugation is formed by axial compression. The external inward-forming method depends on either preforming the tube by mechanical pressure using multi-finger type dies, or by pregrooving using a rotary planetary motion around the tube, both prior to forming of the corrugation by axial compression of the tube.

Although helical metal hose has been able to be produced at a much faster rate, and thus at a lower cost than annular tubing, it has a tendency to twist when compressed or extended axially, leading to undesirable torsional stresses within the hose and at its fitting attachment joints. It is also considerably more difficult to assemble to end fittings since the weld must pass through the root of a corrugation. Alternatively, portions of the hose are left uncorrugated to facilitate the application of fittings. Because of the above factors, the industry has a substantial preference for annular metal hose.

Obviously, in view of its advantages, it would be advantageous if one could manufacture annular metal hose on a continuous fashion similar to the manner in which helical hose is formed. U.S. Pat. No. 2,429,491 discloses a forming tool having a plurality of split, helically mounted discs which can produce a relatively rigid, annularly finned, smooth bored tube of the type used in heat exchangers. However, the resulting tube, in which the fins are formed by displacing the metal of the tube wall, has no correspondence to a metal hose. In a metal hose, the wall thickness stays generally constant and the final hose length is much shorter than the original tube due to the fact that the wall is progressively formed inwardly and outwardly, without any significant change in wall thickness, as the corrugations are produced. U.S. Pat. No. 3,656,331 discloses an apparatus that purports to produce annular corrugated tubing with an annular die ring having an internal helical ridge of less than 360° extent and a pitch equal to the desired corrugation pitch of the finished tube. U.S. Pat. No. 4,215,559 is related to U.S. Pat. No. 3,656,331, but provides for the die ridge to have a maximum height for more than 360°. In U.S. Pat. No. 3,656,331, the depth of penetration is adjusted before the corrugation operation commences. During the operation, the tube is driven axially without rotation through a guide in a predetermined relationship to the speed of rotation of a die carrier about the axis of the tube.

SUMMARY OF THE INVENTION

It is among the objects of the present invention to provide an apparatus which can form annular corrugations in metal hose on a continuous basis and without leaving tool marks on the work which could weaken it or affect its appearance. These and other objects are accomplished by the apparatus of the present invention in which a plurality of dies, each having the form of an angled helical rib formed on the inner periphery of an annular ring, are arranged in pairs adapted to engage opposed surfaces of the tube. Preferably, there are at least two pairs of dies arranged in spaced stages so that corrugations are produced gradually. No matter how many dies are utilized, it is preferable that each successive die have its helical ribs at a closer pitch than the preceding die and that the ribs be dimensioned so as to progressively deepen the corrugations. It is desirable to have at least one complete convolution of a helical rib on each die and preferably several on the final dies so as to smooth out the corrugations. If desired, to increase the corrugating speed, multiple start helical ribs can be provided. The dies are preferably arranged so that they can rotate in equal angular synchronization relative to each other by a series of timing chains which are mounted to sprockets which are slidably fixed to a common shaft. However, in the disclosed embodiment, the synchronized dies only rotate by virtue of their contact with the tube which is positively rotated at its upstream end and mounted on a carriage. The carriage, which rotates the tube, rolls on rails and is free to move axially of the tube as the tube is threadedly moved forward by its rotation relative to the dies. Alternatively, the shaft which connects to each timing chain could be driven instead of driving the tube.

Although it is preferable that all dies move together in synchronization, it should be noted that it is sometimes possible to produce short lengths of tubing of small diameter without synchronization. This is done by very carefully forming the internal diameter of the successive die rings to exactly correlate to the internal diameters of the corrugations they produce so that the surface speeds of rotation and the revolutions of each die per unit of time will be identical for all dies. However, since any slippage will cause a die to rotate out of its proper position, synchronization is quite essential for trouble-free operation. Although it is preferable that each successive die have its helical ribs at a closer pitch than the preceding die, it is not essential in the situation where there are at least three die rings in operation and small diameter tubing is being produced which requires only a small amount of reduction. For example, in a machine having four dies and capable of producing $\frac{1}{4}''$–$1\frac{1}{2}''$ diameter corrugated tubing, the dies for forming $\frac{1}{4}''$ tubing might have, respectively, 4, 6, 6, 10 threads per inch while the dies for $\frac{1}{2}''$ tubing might have $3\frac{1}{2}$, $5\frac{1}{2}$, 7 and 8 t.p.i. In the first instance, the two center dies can be duplicates to save tooling cost and the second die with 6 t.p.i. would merely serve to transfer the tube, help maintain its driving relation with the other dies and maintain a radial pressure on the tube relative to the opposing pressure exerted on it by the immediately adjacent dies or guides.

To render the apparatus as versatile as possible, the various dies are preferably mounted so that they can be tilted, moved axially relative to the tube axis, or moved transversely of the tube axis. Axial movement of the dies relative to the tube can be achieved by rotation of one die relative to the next, by movement of the die blocks relative to the base of the apparatus, or a combination of both.

DESCRIPTION OF THE PREFERRED EMBODIMENT

Figure 1:
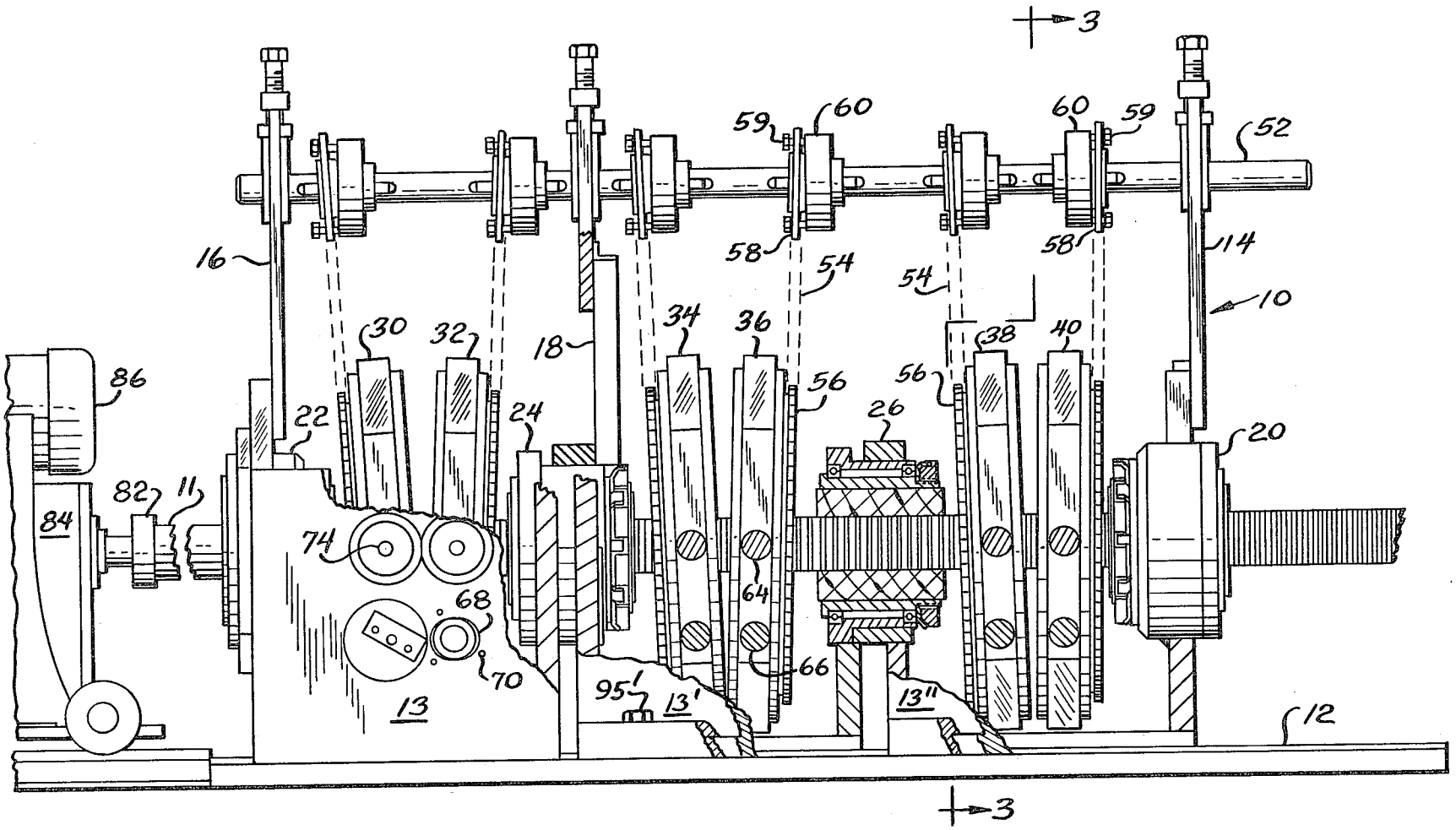
FIG. 1 is a front plan view of the corrugating apparatus of the invention with some portions partially broken away or sectioned for clarity.

Referring to FIG. 1, the improved annular corrugating apparatus is indicated generally at 10 and shows a tube 11 being corrugated. The apparatus has a horizontal support base 12, a fixed front vertical support plate 13, movable front support plates 13', 13'', and a plurality of axially transverse support plates 14, 16 and 18. Tube support bearings 20, 22, 24 are mounted in the plates 14–18 and an additional tube support bearing 26 is also provided. Positioned between the bearings are 3 die stages, the first of which comprises first die block 30 and second die block 32. The second stage comprises third die block 34 and fourth die block 36 while the third stage comprises fifth die block 38 and sixth die block 40. The number of die blocks provided can vary depending upon the diameter and range of tube sizes to be produced with the apparatus, with the larger sizes requiring more stages.

At the top of the apparatus 10 a synchronizing idler shaft 52 is mounted. A plurality of sprocket drive chains 54 connect large sprockets 56 carried by each die block to small sprockets 58 which are mounted by bolts 59 on mounting heads 60 keyed to shaft 52. The small sprockets 58 have a ball joint mounting (not shown) within the mounting heads 60 and the heads 60 are nonrotatably keyed to key slots so they can move axially of the idler shaft 52. Thus, movements of the drive chains 54 which must take place as the die blocks 30–40 are tilted or moved axially can be readily accommodated.

Each of the die blocks or holders 30–40 are mounted for tilting movement about a tilt shaft 64 and alternate die blocks are mounted for movement toward or away from the tube axis from either the front support wall 13 or the rear support wall 65. Shafts 66 in each die block can move in elongated slots 68 in the front or rear walls 13, 65 and are locked in varying positions of tilt adjustment by screw fasteners 70. The correct angle of tilt of any particular die will be the angle at which the helical thread ribs 30''–40'' (FIG. 2) will contact the tube 11 in a plane normal to the axis of tube 11. Since alternate dies, such as dies 38 and 40, will contact the tube on the back or front side of the ribs 38'', 40'', the pair of dies which form each stage must be tilted in opposite directions.

Figure 3:
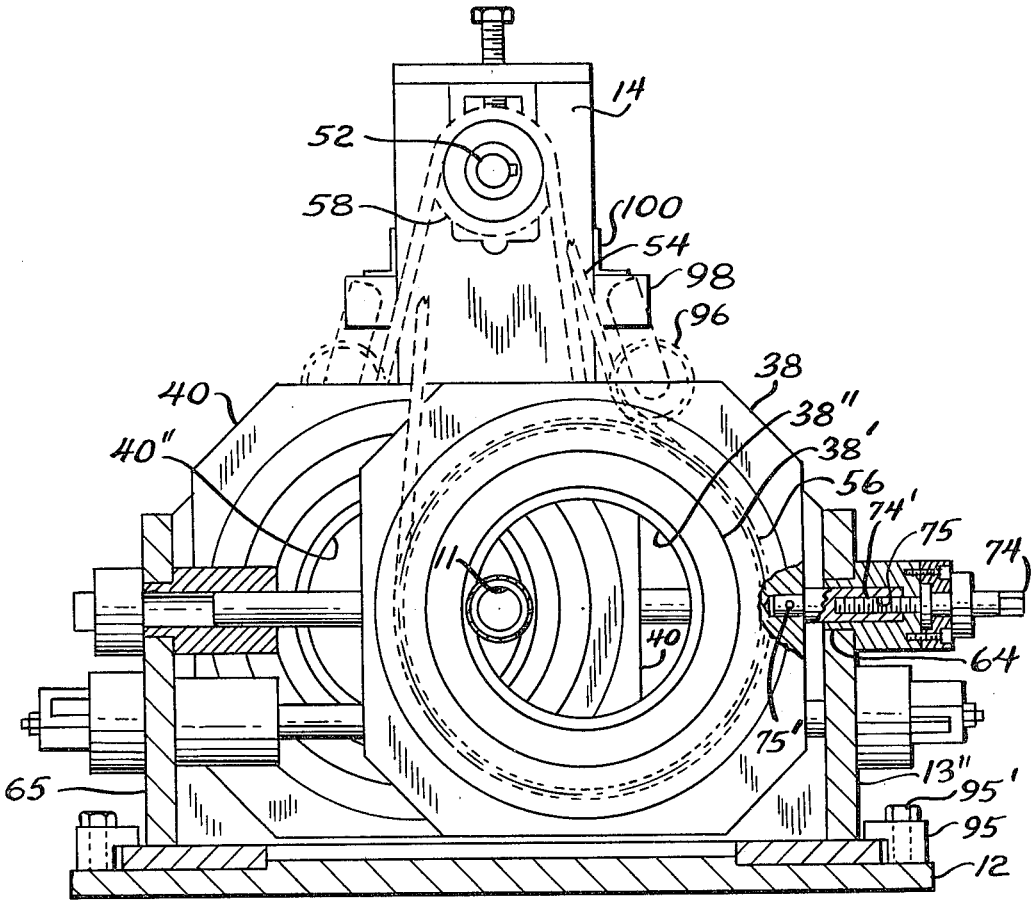
FIG. 3 is an end view taken on line 3—3 of FIG. 1.

The penetration depth of each die rib 30''–40'' is controlled by a feed device which could be mechanically, pneumatically, or hydraulically activated but is shown in FIG. 3 as a manually operable member 74. The member 74 rotates but does not move axially to turn threaded portion 74' which is engaged with an axially movable but nonrotatable nut member 75. The nut member 75 is pinned to the die block 38 by a pin 75'.

Figure 2:
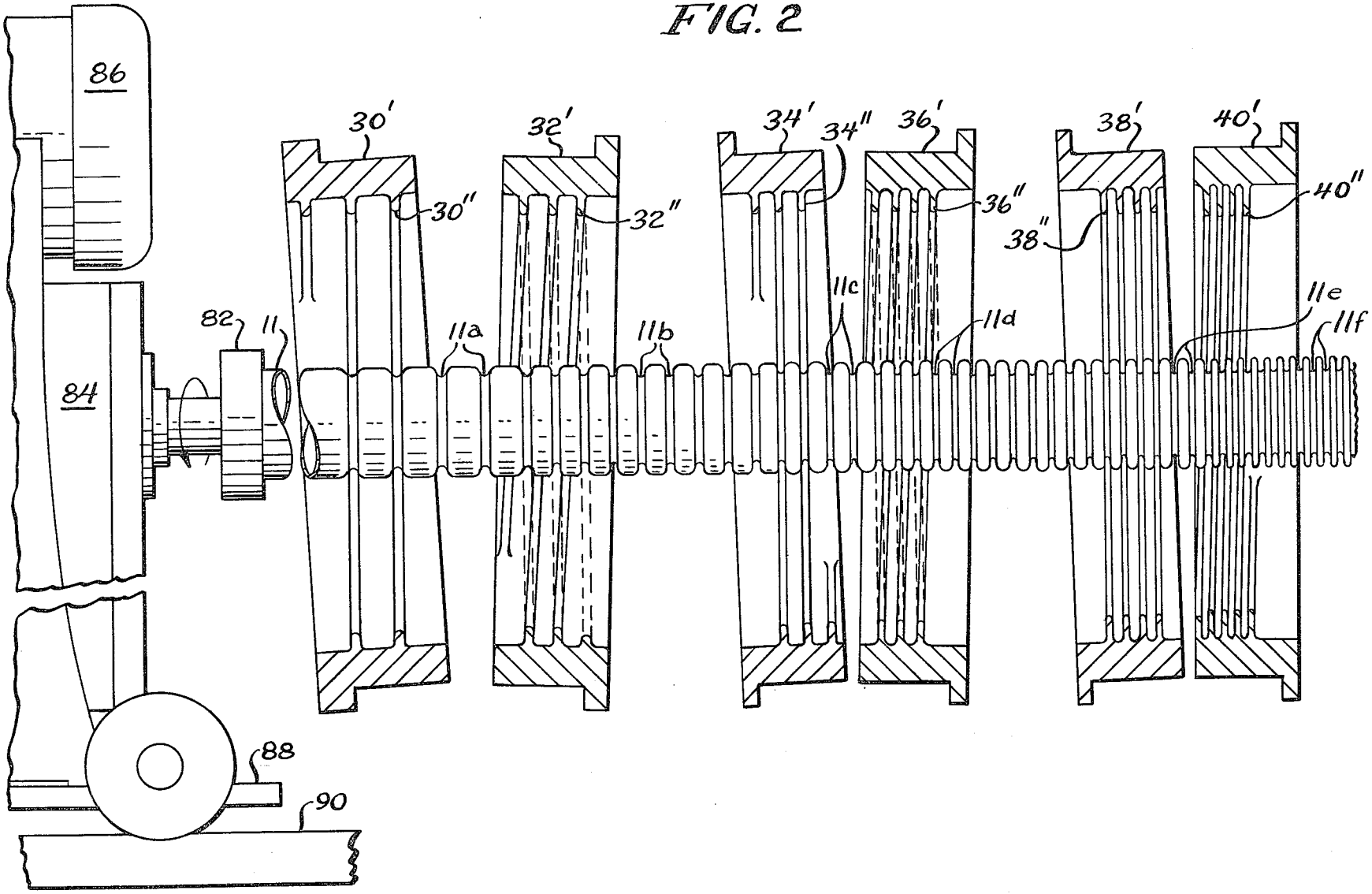
FIG. 2 is a front view showing the dies in section and also illustrating the tube rotation carriage and the changes in tube configuration introduced at each die station.

FIG. 2 schematically illustrates the successive stages of forming corrugations in a tube 11. The tube is affixed to a drive chuck 82 which rotates it via a gear drive 84 powered by a motor 86. The drive is mounted on a wheeled carriage 88 which is free to travel along rails 90 as the dies 30''–40'' pull the tube to the right. As previously noted, the dies are not motor-driven but rotate in synchronism solely by virtue of their contact with the rotating tube 11.

FIG. 3 is an axial end view taken on line 3—3 of FIG. 1 and illustrates the mechanism 52-58 for synchronizing the rotation of the various dies 38'', 40''. The view also illustrates a means 74, 74' and 75 for moving the dies (die 38'' is shown) into or out of engagement with opposite sides of the tube 11.

When the apparatus is being set up to corrugate a particular tube, it is necessary that the corrugations produced by each die to the left in FIG. 2 be picked up by a lead-in portion of the die thread in a succeeding die. Looking at FIG. 2, the corrugation 11*a* should arrive at the die 32' so that it is exactly aligned with the lead-in portion of die rib or thread 32''. This can be accomplished by slightly rotating the downstream die relative to the upstream die as needed. Additional axial adjustment of the die blocks can be obtained by moving the vertical walls 13', 13'', 65 relative to the base 12 and clamping them with clamp angles 95 and bolts 95'. In order to accommodate the in-and-out movement of the die blocks and tilting of the dies, chain tighteners are provided in the form of idler sprockets 96 which are weight or spring biased into engagement with the chains 54. The sprockets 96 are carried by a support arm 98 which is mounted on longitudinal brackets 100 affixed to vertical support members 14–16.

In operation, a tube 11 which is to be corrugated into a metal hose is attached at its upstream end to the drive chuck 82 (FIG. 2) of the wheeled carriage 88. The length of the tube 11 which can be accommodated is dependent on the length of the guide rails 90. The downstream end of the tube is preferably positioned in the support bearing 22 and first and second dies 30, 32. The die ribs 30'', 32'' are then moved into operative position so as to produce corrugations. The corrugating continues until the corrugations formed in the first stage overlie the open and inoperative third and fourth die ribs 34'', 36'' at which time the latter dies are brought into engagement with the tube. Similarly, the corrugation operation continues until the corrugations initially produced by the second stage overlie the open fifth and sixth die ribs 38'', 40''. The latter ribs are then brought into engagement with the tube and the corrugating operation is continued until the rotating drive chuck 82 gets so close to the end wall 16 that it must be stopped and the tube withdrawn from the chuck. The corrugating can be stopped as each new die stage is fed into contact with the tube or the tube can be continuously rotated.

The apparatus is able to produce corrugations on materials such as stainless steel, bronze and carbon steel which are commonly corrugated to form metal hose. In some instances, thinner wall material can be used than has been used in prior art equipment. For example, in an apparatus for making small diameter hose in the range of $\frac{1}{4}''$–$1\frac{1}{2}''$, material with a wall thickness as low as about 0.008" appears to corrugate quite well, at least for the $\frac{1}{4}$"–$\frac{3}{4}$" tube sizes. A single corrugation is produced for every revolution of one of the dies 30'–40' so it is important that each die have at least one complete revolution of its die rib at full depth. The downstream dies preferably have several convolutions to smooth the corrugations and provide increased contact with the rotating tube. It is also important that the dies have relieved lead-in portions which can smoothly ease the die ribs into the corrugations. The dies preferably have an internal diameter about 2–3X the internal diameter of the hose produced. However, for purposes of clarity, the drawings show the tubing to be much smaller than it should be in practice.

I claim as my invention:

1. An apparatus for annularly corrugating metal tubing comprising:

(a) a first annular die ring adapted to encompass the tubing, said first die ring including a helical internal ridge portion having a tapered lead-in portion and an inner diameter greater than the outer diameter of the tubing and extending circumferentially at a predetermined internal diameter for at least 360° around the interior wall of said first die and adapted to indentably bear on the exterior of said tubing in a substantially radial direction;

(b) at least a second annular die ring adapted to encompass said tubing downstream of said first die ring, said second die ring including a tapered lead-in portion and a helical internal ridge which extends circumferentially for at least 360° at a predetermined internal diameter and which has an internal diameter which is greater than the outer diameter of the tubing which it is adapted to engage, the helical internal ridge in said second die ring having a smaller thread pitch than said first die ring;

(c) means for incurring relative rotation between said tubing and said die rings whereby to axially displace said tubing continually through said dies while simultaneously forming annular corrugations therein; and (d) means for synchronizing the rotation of said die rings so that they rotate at the same angular speed.

2. The apparatus of claim 1 wherein said first and second die rings are positioned axially adjacent each other in a first corrugating stage where they are in engagement with opposite sides of the tubing.

3. The apparatus of claim 2 wherein a second corrugating stage is provided comprising third and fourth die rings positioned downstream of said first stage.

4. The apparatus of claim 1 wherein the tube is positively rotated upstream of the corrugating apparatus.

5. The apparatus of claim 1 wherein the means for synchronizing comprises large sprockets carried by each die ring and small sprockets carried by a common shaft, said small sprockets being keyed to said common shaft for rotation with each other, the large and small sprocket for each die ring being connected by a sprocket chain.

6. The apparatus of claim 5 wherein said small sprockets can be moved axially of said common shaft to accommodate changes in the axial position or angle of tilt of said die rings.

7. The apparatus of claim 1 wherein the internal diameter of said die rings is approximately 2–3X the internal diameter of the corrugated tubing produced thereby.

* * * * *